United States Patent [19]

Andreev et al.

[11] Patent Number: 4,554,201

[45] Date of Patent: Nov. 19, 1985

[54] MULTILAYER COATINGS OF METAL-CUTTING TOOLS

[75] Inventors: Anatoly A. Andreev; Igor V. Gavrilko, both of Kharkov; Alexeí G. Gavrilov, Moskovskaya; Anatoly S. Vereschaka; Viktor P. Zhed, both of Moscow; Valentin G. Padalka, Kharkov; Andrei K. Sinelschikov, Moscow; Vladimir T. Tolok, Kharkov, all of U.S.S.R.

[73] Assignee: Vsesojuzny Nauchno-Issledovatelsky Instrumentalny Institut, Moscow, U.S.S.R.

[21] Appl. No.: 605,862

[22] Filed: May 1, 1984

Related U.S. Application Data

[63] Continuation of Ser. No. 438,867, Oct. 18, 1982, abandoned.

[51] Int. Cl.[4] ..... B23P 15/28; B32B 15/04; B32B 33/00

[52] U.S. Cl. ..... 428/215; 428/698; 428/699

[58] Field of Search ..... 427/249, 255.2; 428/215, 469, 699, 698

[56] References Cited

U.S. PATENT DOCUMENTS

| | | | |
|---|---|---|---|
| 3,836,392 | 9/1974 | Lux et al. | 428/335 |
| 4,035,541 | 7/1977 | Smith et al. | 428/699 X |
| 4,101,703 | 7/1978 | Schintlmeister | 428/699 X |
| 4,239,536 | 12/1980 | Yamamoto et al. | 428/380 X |
| 4,284,687 | 8/1981 | Dreyer et al. | 428/469 X |
| 4,337,300 | 6/1982 | Itaba et al. | 427/255.2 X |
| 4,357,382 | 11/1982 | Lambert et al. | 428/699 X |
| 4,461,799 | 7/1984 | Gavrilov et al. | 428/698 X |
| 4,474,849 | 10/1984 | Fujimori et al. | 428/332 |

FOREIGN PATENT DOCUMENTS

| | | | |
|---|---|---|---|
| 2528255 | 2/1976 | Fed. Rep. of Germany | 428/627 |
| 2144824 | 10/1976 | France . | |
| 56-3670 | 1/1981 | Japan | 428/699 |
| 1295688 | 11/1972 | United Kingdom . | |

*Primary Examiner*—Henry F. Epstein
*Attorney, Agent, or Firm*—Lilling & Greenspan

[57] ABSTRACT

A multilayer coating of metal-cutting tools is composed of alternating layers of two components. One of these is a nitride or carbide of a metal of group IV. The other is a nitride, carbide, boride or silicide of a metal of group VI. The layer thickness of the group IV metal compound is from 0.05 to 0.5 μm, and the layer thickness of the group VI metal compound constitutes 15 to 40 percent of the layer thickness of the group IV metal compound. The multilayer coating is preferably intended for application to metal-cutting tools used for machining high-alloyed materials.

2 Claims, No Drawings

MULTILAYER COATINGS OF METAL-CUTTING TOOLS

This is a continuation of application Ser. No. 438,867 filed Oct. 18, 1982, now abandoned.

FIELD OF THE INVENTION

The present invention relates to metal working, and, more particularly to multilayer coatings of metal-cutting tools.

DESCRIPTION OF THE PRIOR ART

Known in the art is a multilayer coating composed by alternating layers of two components, one being a nitride or carbide of a metal of group IV, and the other being a pure metal (cf. R. F. Bunshan and Shebaik, Research/Development, June, 1975).

The microhardness of layers of group IV nitrides and carbides is from 2200 to 3000 kg/mm$^2$, and that of layers of pure metal is from 600 to 900 kg/mm$^2$. The soft layers of pure metal prevent cracking of the brittle layers, and as a whole contribute to an increased strength of the coatings. Such coatings are highly resistive to failure under variable loads applied during machining of structural steel, and do not spall when tools are subjected to redressing on one of their working surfaces. However, in cutting hard-to-machine (high-alloyed) materials, the tool endurance is low due to adhesive wear occuring by virtue of sticking of the coating and machined part materials. An elevated temperature in the cutting area (resulting from low heat conduction of said materials) and low cutting rates characteristic to cutting of hard-to-machine materials facilitate the sticking processes. Plastic active pure metals more readily stick to the machined materials than the hard and more passive compounds thereof. Therefore, inclusion of pure metal layers in the coatings leads to higher rates of adhesive wear of the coating as a whole.

DISCLOSURE OF THE INVENTION

It is an object of the present invention to provide a multilayer coating of metal-cutting tools, comprising such components which would retain a high strength of the coating and at the same time would feature a lower sticking ability in working various materials, including hard-to-machine materials, whereby the adhesive wear of the coating can be minimized, and the wear resistance of the coating as a whole can be raised.

This object is attained by a multilayer coating of metal-cutting tools composed by alternating layers of two components, one being a nitride or carbide of a metal of group IV, and the other being, according to the invention, a nitride, or carbide, or boride, or silicide of a metal of group VI.

It is preferable that the layer thickness of the group IV metal compound be from 0.05 to 0.5 μm, and the layer thickness of the group VI metal compound be 15 to 40 percent of that of the group IV metal compound.

The multilayer coating comprising the components according to this invention and having layer thicknesses indicated above is characterized by low adhesive interaction with the material being machined, with the result that the wear of the coating is reduced, and the wear resistance of the tools bearing such a coating is increased.

In working hard-to-machine materials, the high microhardness of carbides and nitrides of a metal of group IV prevents plastic deformation directed at right angles to the coating surfaces. The strenghtening coating comprises up to 500 alternating layers of groups IV and VI metal compounds separated by interfaces. Each interface provides a sink of energy liberated during crack formation in the upper layer in the cutting process, and substantially inhibits spreading of cracks into the lower layers.

The group VI metal compounds forming thinner layers improve the wear resistance; the wear products oxidized at high temperatures in the cutting area operate as a hard lubricant, and thus reduce friction, cutting force and temperature of the tool cutting lip, and the molybdenum, chromium and tungsten oxides form a passive barrier which precludes adhesive interaction between the coating and material being machined, and, hence, reduces the wear of the coating as a whole.

The thickness of the metal compound layers was determined by experiment, with provisions for optimum lubricating properties and adhesive interaction between the coating and material taken into account.

DETAILED DESCRIPTION OF THE INVENTION

The multilayer coating herein proposed can be manufactured by simple techniques, for example, by the traditional method of condensation of material involving ion bombardment.

The layers of the above-mentioned components are applied by a single process cycle. For this purpose, the metal cutting tools are placed on a rotary platform inside a vacuum chamber. The chamber is equipped with cathodes made of groups IV and VI refractory metals. A negative potential is applied to the tools, and arc discharges are produced in the space between the tools and cathodes. As a result, metallic-phase atoms dislodged from the cathodes are ionized in the arcing area. The resulting positive ions are accelerated due to the negative potential of the tools, strike the surfaces thereof, and effect cleaning and heating of said surfaces.

After the tool surfaces are heated to the required temperature, a reagent gas (such as nitrogen, methane, silane, or borane) is injected into the vacuum chamber, and a wear-resistant and heatproof compound of refractory metals precipitates on the tool surfaces.

For better understanding of the invention, the following examples of its practical embodiment are given by way of illustration.

EXAMPLE 1

A cutting tool using three-angular through-away tips made of hard alloy of P, K group to ISO was coated with a multilayer coating with a total thickness of 20 μm applied by the method described above. The coating was composed of alternating layers of TiN-$Mo_2N$, with the layers 0.05 μm and 0.015 μm thick, respectively.

The sample was tested by plain turning of heatproof high alloy composed of the following components given in percent by weight: 0.03 to 0.07 of C; 0.5 maximum of Si; 0.4 maximum of Mn; 13 to 16 of Cr; 73 of Ni; 2.5 of Ti; 1.45 to 1.2 of Al; 2.8 to 3.2 of Mo; 1.9 to 2.2 of Co; and the rest of Fe.

The cutting conditions were: cutting depth from 0.3 to 0.5 mm; cutting rate 37.6 m/min; feed 0.15 mm/rev.

The endurance of the tool using the multilayer coating amounted to 20.2 min.

In the same manner examples 2 through 9 were realized, with the components of the multilayer coating and the thickness thereof changed in each case in the range specified in this invention.

The test results of examples 1 through 9 are listed in Table 1.

In addition, cutting tools similar to that described in Example 1 and coated with prior-art coatings of alternating layers of titanium nitride and titanium, with a total thickness of 20 μm were subjected to tests for deriving comparative data. The results obtained in testing the cutting tools bearing the traditional coatings are presented in the same Table 1, lines 10 and 11.

The above-mentioned test results show that the endurance of the cutting tool bearing the multilayer coacting according to the invention is 4 5 times above that of the cutting tools bearing prior-art multilayer coatings of titanium nitride and titanium.

TABLE 1

| Line No. 1 | Coating layer components 2 | Layer thickness, μm 3 | Tool endurance, min 4 |
|---|---|---|---|
| 1 | TiN | 0.05 | 20.2 |
| | $Mo_2N$ | 0.015 | |
| 2 | TiN | 0.08 | |
| | $Mo_2N$ | 0.028 | 25.7 |
| 3 | TiN | 0.1 | |
| | $Mo_2N$ | 0.02 | 19.6 |
| 4 | ZrN | 0.5 | 26.3 |
| | $Mo_2C$ | 0.15 | |
| 5 | TiC | 0.3 | |
| | CrN | 0.1 | 20.3 |
| 6 | HfC | 0.1 | 26.5 |
| | WC | 0.03 | |
| 7 | ZrC | 0.4 | |
| | $Mo_2B$ | 0.1 | 20.8 |
| 8 | ZrN | 0.2 | |
| | $MoSi_2$ | 0.03 | 19.1 |
| 9 | TiN | 0.3 | |
| | $CrB_2$ | 0.1 | 23.4 |
| 10 | TiN | 0.55 | |
| | Ti | 0.15 | 5.1 |
| 11 | TiN | 2.5 | |
| | Ti | 0.5 | 4.7 |

EXAMPLE 10

A herring-bone cutter, diameter 80×45 mm, made of an alloy composed of 18 percent by weight of W, 2 percent by weight of V, 8 percent by weight of Co, and the rest of Fe, was coated by the foregoing method with a multilayer coating of TiN-$Mo_2N$, with a total thickness of 20 μm, and layer thickness of 0.05 and 0.015 μm, respectively.

The cutter was tested by cutting a sample of alloy comprising 20 percent by weight of Cr, 1 percent by weight, maximum, of Mn, 1 percent by weight, maximum, of Ti and the rest of Fe. The cutting conditions were as follows:

(a) Speed . . . 18 rpm
(b) Feed . . . 31.5 mm/min
(c) Cutting depth . . . 4 mm

One cutter bearing the coating according to the present invention proved to endure cutting 44 parts.

In testing a similar cutter bearing a traditional coating of alternating layers of TiN-Ti, it was found that one cutter endures machining o parts only.

EXAMPLE 11

The test was conducted in the same way as in Example 10, with the only difference that the components of the multilayer coating were ZrN—MoC, with layer thickness of 0.5 and 0.15 μm, respectively. The test showed that one cutter bearing the above-mentioned coating is fit to endure working 42 parts, that is, the endurance of the cutter is about 5 times above that of the cutter provided with a prior-art multilayer coating.

EXAMPLE 12

The test was conducted in the same way as in Example 10, with the only difference that the components of the multilayer coating were HfC—WC, with the thickness of layers equal to 0.1 μm and 0.03 μm, respectively. The test showed that one cutter provided with the foregoing coating was fit to endure machining 49 parts, that is, the endurance increased by about 6 times.

EXAMPLE 13

A broaching tool, measuring 150×25×30 mm and made of an alloy composed of 18 percent by weight of W and the rest of Fe, was coated by the above method with a multilayer coating consisting of alternating layers of TiC and CrC, with a total thickness of 20 μm, and layer thickness of 0.3, 0.1 μm.

The broaching tool was tested by working a sample of stainless steel composed of the following components in percent by weight: 0.13 to 0.18 of C; 0.6 maximum of Si; 0.6 maximum of Mn; 11 to 13 of Cr; 15. to 2.0 of Ni; 1 maximum, of W; 1.35 to 1.65 of Mo; 0.18 to 0.3 of V; 0.3 of Nb; and the rest of Fe.

One broaching tool prooved to endure machining 197 parts.

For comparison, a similar broaching tool bearing a traditional multilayer coating of TiN—Ti was subjected to tests. One broaching tool bearing the prior-art coating was found fit for working 45 parts only, that is, the endurance thereof was 4.5 times lower.

EXAMPLE 14

The test was conducted like in the case with Example 13, with the only difference that the components of the multilayer coatings were ZrN—$MoSi_2$, with the coating thickness equal to 0.2 and 0.03 μm, respectively. One broaching tool endured working 165 parts, that is, the endurance of the broaching tool increased by 3.1 times as compared with the tool bearing a prior-art multilayer coating.

Industrial Applicability

The multilayer coating according to the present invention can most advantageously be used for treatment of any metal-cutting tools, such as drills, cutters, cutting tools, etc., intended to raise the endurance thereof, and is particularly useful for tools used to machine high-alloyed (difficult-to-machine) steel grades and high alloys.

We claim:

1. A multilayer coating of metal-cutting tools composed by alternating layers of two components, one being a nitride or carbide of a metal of group IV, and the other being a nitride, carbide, boride or silicide of a metal of group VI.

2. A multilayer coating of metal-cutting tools as claimed in claim 1, characterized in that the layer thickness of group IV metal compound is from 0.05 to 0.5 μm, and the layer thickness of group VI metal compound amounts to 15 to 40 percent of the layer thickness of the group IV metal compound.

* * * * *